United States Patent [19]

Beam

[11] Patent Number: 4,604,837

[45] Date of Patent: Aug. 12, 1986

[54] COVER MEMBER FOR RAIN GUTTERS

[76] Inventor: Tony D. Beam, P.O. Box 777, Stanley, N.C. 28164

[21] Appl. No.: 775,604

[22] Filed: Sep. 13, 1985

[51] Int. Cl.[4] ..... E04D 13/00

[52] U.S. Cl. ..... 52/12

[58] Field of Search ..... 52/12, 11; 405/119; 210/162, 474, 477, 801

[56] References Cited

U.S. PATENT DOCUMENTS

| | | | |
|---|---|---|---|
| 546,042 | 9/1895 | Van Horn | 52/58 X |
| 603,611 | 5/1898 | Nye | 52/12 |
| 836,012 | 11/1906 | Cassen | 52/12 |
| 873,407 | 12/1907 | Behl | 52/11 X |
| 891,405 | 6/1908 | Cassens | 52/12 X |
| 2,669,950 | 2/1954 | Bartholomew | 52/12 |
| 2,672,832 | 3/1954 | Goetz | 52/12 |
| 2,873,700 | 2/1959 | Heier | 52/12 |
| 4,404,775 | 9/1983 | Demartini | 52/12 |
| 4,435,925 | 3/1984 | Jefferys | 52/12 |
| 4,445,301 | 5/1984 | Tanski | 52/11 |
| 4,497,146 | 2/1985 | Demartini | 52/12 |

FOREIGN PATENT DOCUMENTS

| | | | |
|---|---|---|---|
| 578461 | 6/1959 | Canada | 52/11 |

OTHER PUBLICATIONS

American Roofer, Jul. 1949.

*Primary Examiner*—William F. Pate, III
*Assistant Examiner*—Jean M. LaKemper
*Attorney, Agent, or Firm*—Shefte, Pinckney & Sawyer

[57] ABSTRACT

A cover member adapted to be mounted in a conventional gutter on a building structure in covering relation to the open top to the gutter trough provides a forward upwardly-extending lip portion having a curved outward surface adapted to form a dam to water runoff from the building structure to slow the speed of water runoff flowing over the lip portion to cause the overflowing water to follow the curved outward surface of the lip portion into the gutter while causing leaves and like debris to fall gravitationally over the lip portion outwardly of the gutter. In one embodiment, the lip portion is formed as an integral upwardly and rearwardly curled forward edge to the cover member. In a second embodiment, a coil spring rests between the curled lip portion and the front wall of the gutter to act as a filter against debris entering the gutter. In a third embodiment, the lip portion is formed as a circular bead fitted to the forward edge of the cover member, with a spiral groove in the bead serving to direct overflowing water runoff into the gutter. As desired, drain openings may be formed in the cover member adjacent the lip portion to increase the capacity of the cover member for handling water runoff.

24 Claims, 6 Drawing Figures

COVER MEMBER FOR RAIN GUTTERS

BACKGROUND OF THE INVENTION

The present invention relates generally to rain gutters for building structures and the like and, more particularly, to associated cover members for such gutters adapted and intended to direct water runoff from building structures into such gutters while preventing leaves and other debris from entering the gutter.

An important design criteria in the planning and construction of building structures is the collection and removal of rain water and the like from the roof and foundational area surrounding the building structure to avoid potential structural damage thereto by flooding of the structure and/or erosion of the surrounding earth. Accordingly, it is a common practice, particularly in home construction, to provide rain gutters at the outward terminal edges of the building roof together with downspouts communicating with the gutters to collect and direct water runoff from the roof away from the building.

A long-standing and yet substantially unsolved problem associated with the use of conventional gutter systems is the undesired collection of leaves, twigs, pine needles and other debris in the gutters, which inhibits the proper functioning of the gutters for water collection and drainage and ultimately causes complete clogging of the gutter system. A number of apparent disadvantages result. Accumulation of debris in the gutters creates an increased load both on the gutter structure itself and on the supporting structural members of the building, thereby creating a risk of structural damage to one or both thereof. In addition, gutters having accumulated debris therein are more prone to flooding over the gutter edges, posing a further risk of flooding and water damage to the building structure. Furthermore, gutters having collected debris therein are highly subject to premature corrosion and possible freezing damage during the winter months. Accordingly, it has traditionally been necessary to manually clear conventional gutter systems of accumulated debris on a periodic basis, but such maintenance measures still serve only to minimize the effects of, rather than eliminate, debris accumulation.

In the past, various solutions to the above-described problems have been proposed. For instance, screen-like gutter inserts are available to cover the open top of conventional trough-like gutters to permit water to flow thereinto while preventing leaves and other debris from entering the gutters. However, in actual practice, it has been found that such screens merely serve to collect leaves, pine needles and the like thereon requiring that the screens themselves be periodically cleared of accumulated debris. On the other hand, various deflector members as well as entirely redesigned gutter structures have been proposed having the two-fold purpose of permitting water drainage while preventing debris accumulation. Most of such deflector members and gutter structures have in common the provision of some form of cover positioned above the collection trough of the gutter system with an arcuate portion extending downwardly and reversely from the cover theoretically to cause water runoff to follow the contour of the cover and its arcuate portion into the trough area under the effect of surface tension between the water and the cover member while preventing leaves and like debris from entering the gutter trough since such debris will not similarly follow the contour of the cover member. Representative examples of such deflectors and gutter structures are disclosed in U.S. Pat. Nos. 546,042; 603,611; 836,012; 891,405; 2,669,950; 2,672,832; 4,404,775; and 4,497,146. While the basic concept underlying all of these prior structures is now rather old, it is believed that no commercially practical and successful embodiment of this concept has yet been introduced. U.S. Pat. No. 4,404,775, suggests that prior structures lacked sufficient reliability and effectiveness in their intended manner of operation because the arcuate portions of prior structures were incapable of producing and maintaining sufficient surface tension with water runoff to insure the desired flow of water therealong into the gutter trough. Other reasons for the lack of commercial acceptance of these structures may be their increased costs and less attractive aesthetic appearances in comparison with traditional gutter structures.

In contrast, the present invention provides a low-cost cover member for original or retrofit use with conventional gutter structures, thereby having the same aesthetic appearances thereas, the cover member being uniquely effective to direct water runoff into the associated gutter while separating therefrom leaves and other debris.

SUMMARY OF THE INVENTION

The cover member of the present invention is adapted for use in association with a building gutter of the conventional type having spaced upright front and rear walls and a bottom wall extending therebetween to form a collecting trough having an open top. Such conventional gutters are adapted for disposition below a terminal edge of a roof of a building structure with the rear wall of the gutter most closely adjacent to the building structure for collecting water runoff from the roof.

Briefly described, the present cover member includes a cover plate portion having a rearward region and a forward region, the cover plate portion being adapted for disposition in covering relation over the open top of the gutter with the rearward region extending along the rear wall of the gutter and beneath the terminal edge of the roof and with the forward region extending along the front wall of the gutter and outwardly of the terminal edge of the roof. The cover member further includes a lip arrangement extending upwardly along the forward region of the cover plate portion and having a curved forwardly-facing outward surface. In this manner, the lip arrangement forms a dam to water runoff from the roof flowing across the cover plate portion to slow the speed of such water runoff flowing over the lip arrangement to cause the overflowing water runoff to flow along the curved outward surface of the lip arrangement and into the gutter while causing leaves and like debris flowing with the water runoff to fall gravitationally over the lip arrangement outwardly of the front wall of the gutter. In the preferred embodiment, the cover plate portion is adapted to be oriented at a downward incline from its rearward region to its forward region and is provided with longitudinal corrugations to limit surface contact of debris with the cover plate portion to prevent debris adherence thereto.

To facilitate retrofitting of the cover member to existing gutters of the described conventional type, the cover member includes a mounting leg extending downwardly from the rearward region of the cover plate portion for disposition within the trough of the gutter in upstanding relation on the bottom wall thereof adjacent the rear wall thereof to support the cover plate portion and the lip arrangement in covering relation over the associated gutter.

In one embodiment of the cover member, the lip arrangement is formed as an upwardly-curled forward edge portion of the cover member merging integrally and continuously with the forward region of the cover plate portion. As desired, a filter arrangement, e.g., a coiled wire spring, may be attached to the underside of the curved outward surface of the lip arrangement to extend downwardly therefrom to rest on the front wall of the gutter to prevent passage of leaves and debris between the lip arrangement and the front wall of the gutter while permitting the overflowing water runoff to flow therebetween.

In another embodiment, the lip arrangement is formed as a rounded enlarged bead formed at the forward edge of the forward region of the cover plate portion, the bead having a peripheral groove arrangement, preferably formed spirally in the bead, to direct the water runoff about the bead and into the gutter.

A plurality of drain openings may be formed in the forward region of the cover plate portion at spacings therealong for permitting a portion of the water runoff to flow through the openings into the gutter.

DESCRIPTION OF THE PREFERRED EMBODIMENT

Figure 1:
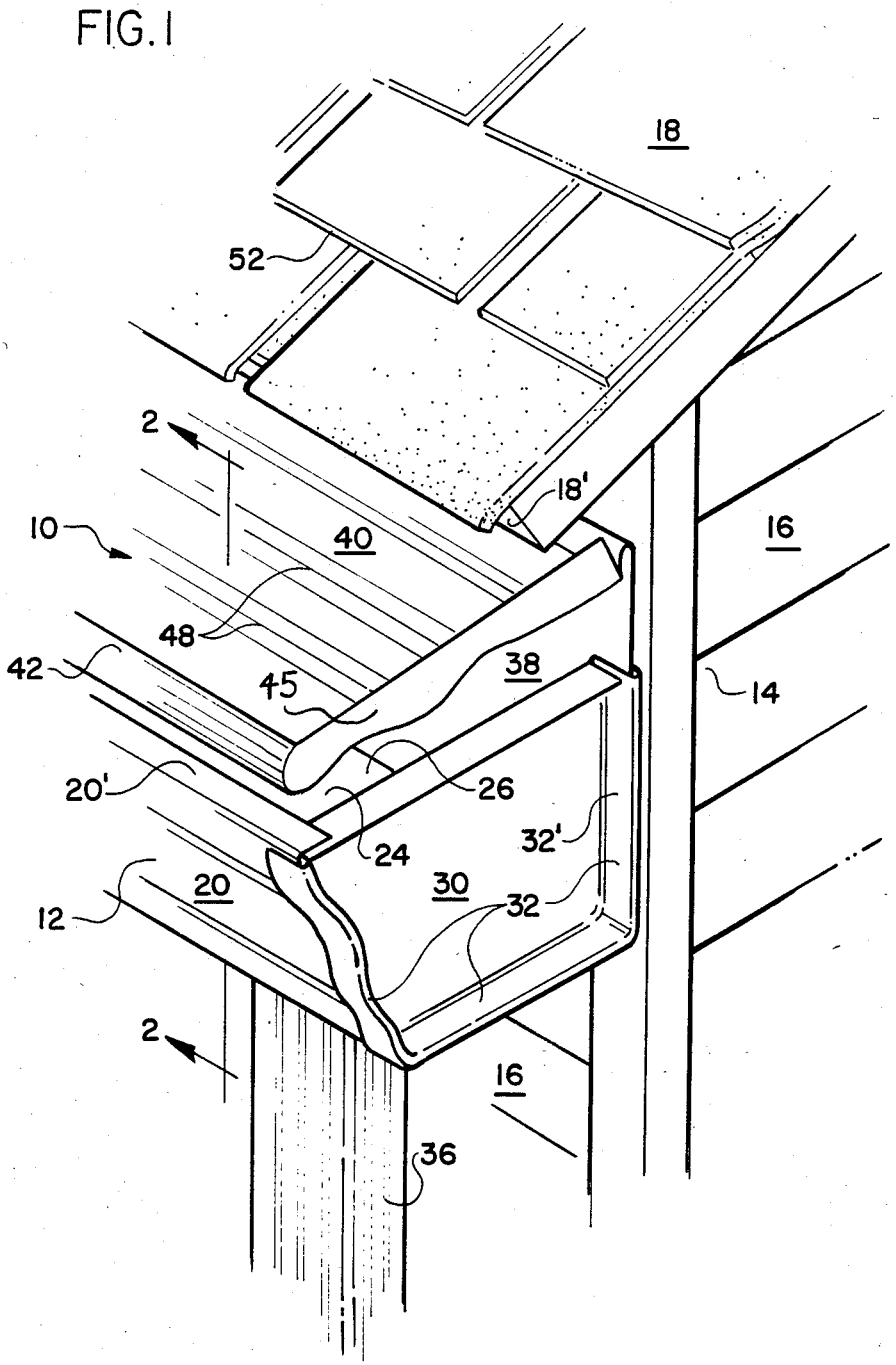
FIG. 1 is a perspective view of one embodiment of a gutter cover member according to the present invention installed in a conventional gutter system on a building structure.
Figure 2:
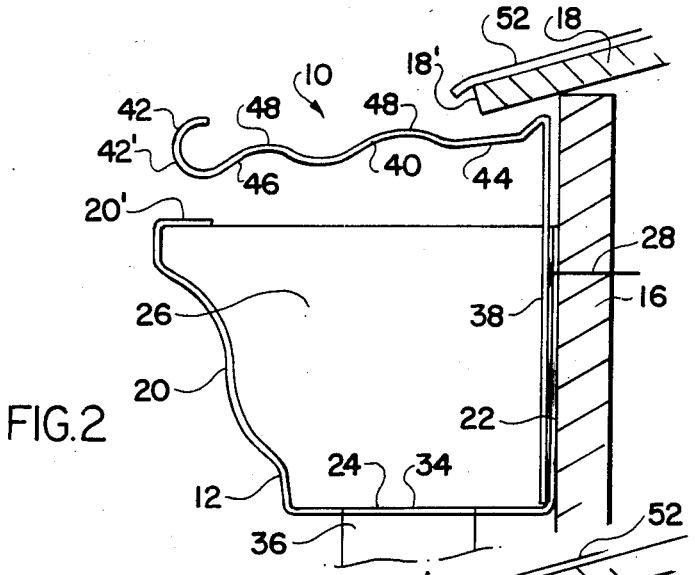
FIG. 2 is a vertical cross-sectional view of the structure of FIG. 1 taken along line 2—2 thereof.

Referring now to the accompanying drawings and initially to FIGS. 1 and 2, a cover member according to the present invention is indicated generally at 10 as preferably installed in assembly with a conventional gutter 12 mounted on a building structure 14. The building structure 14 is representative of a conventionally-constructed single family dwelling or home having vertical exterior walls 16 over which is constructed an angularly-related gable roof 18. As is conventional, each outward and downward terminal edge 18' of the roof 18 extends slightly beyond the adjacent wall 16 of the building structure 14. The roof 18 is preferably covered by shingles 52 or another conventional roofing material. The gutter 12 is of the conventional so-called seamless type formed from continuous length aluminum sheeting to have integral upright, front and rear walls 20,22 and a bottom wall 24 extending transversely therebetween to define a collecting trough 26 having an open top. The front wall 20 of the gutter 12 is formed with a rearwardly-projecting flange 20'. The gutter 12 is mounted on an upright wall 16 of the building structure 14 immediately beneath the terminal edge 18' of the roof 18 with the rear wall 22 of the gutter 12 flush against the wall 16 and rigidly affixed thereto by spikes 28. The opposite ends of the gutter 12 are closed by end caps 30 having a shape corresponding to the cross-sectional shape of the gutter 12 and formed with peripheral channel portions 32 to snugly receive the end edges of the front, rear and bottom walls 20,22,24 of the gutter 12. The bottom wall 24 of the gutter 12 is provided with an opening 34 at at least one end thereof in which is fitted a tubular downspout 36 to extend downwardly from the gutter 12 to a water collection location (not shown).

In conventional operation of the gutter 12, i.e. without the cover member 10, water from rain, melting snow, etc. flows downwardly along the roof 18, over its terminal edge 18' and into the collecting trough 26 of the gutter 12. The gutter 12 is installed on the building wall 16 at a slightly inclined pitch with respect to horizontal to cause water in the collecting trough to flow toward the opening 34 and into the downspout 36. The top opening to the trough 26 being substantially open and unrestricted, falling leaves, twigs, shingle granules, pine needles and the like debris falling on or from the roof 18 are carried with the water runoff along the roof 18 and into the trough 26 of the gutter 12. Typically, the pitched flow of water within the trough 26 is incapable of carrying all such debris to the downspout 36 and, in any event, the downspout 36 is normally not of sufficient diameter to permit passage of all such debris therethrough. Accordingly, such debris typically accumulates in the downspout 36 and the trough 26 of the gutter 12 and, without periodic removal and cleaning of the gutter 12, will ultimately clog the trough 26 and the downspout 36 altogether.

The cover member 10 is formed similarly to the gutter 12 from continuous length aluminum sheeting to have an integrally-formed upright rearward leg portion 38, top cover plate portion 40, and forward lip portion 42. Of course, it will be understood that the cover member may alternatively be formed of any other conventional suitable material, e.g., plastic. The leg portion 38 is substantially flat and planar along the entire length of the cover member 10. The cover plate portion 40 is formed with several longitudinally-extending corrugations 48 and extends outwardly from a rearward region 44 adjacent the leg portion 38 to a forward region 46 adjacent the lip portion 42 at an overall slightly-acute angle with respect to the leg portion 38. The forward outer edge of the cover plate portion 40 is curvingly curled upwardly and rearwardly to form the lip portion 42, and thereby presenting a convexly arcuate forwardly-facing outward surface 42' of the lip portion 42 which merges smoothly with the underside of the cover plate portion 40. Each end of the coverplate portion 40 of the cover member 10 has an integral upwardly bent lip 45 to prevent water runoff from flowing over the outward longitudinal ends of the cover plate portion 40.

The cover member 10 is installed in assembly with the gutter 12 with the rear leg portion 38 slidably fitted at its opposite ends in the rearward upright channel portion 32' of the end caps 30 to the gutter 12 to dispose the leg portion 38 within the trough 26 in upstanding relation on the bottom wall 24 and abuttingly against the rear wall 22. The cover plate portion 40 is thereby supported in covering relation over the open top of the gutter 12 with the rearward region 44 extending along and above the rear wall 22 of the gutter 12 and beneath the terminal edge 18' of the roof 18 and with the forward region 46 and the lip portion 42 extending along the front wall 20 of the gutter 12 at a slight spacing thereabove and outwardly of the terminal edge 18' of the roof 18. In this disposition, the cover plate portion 40 is oriented at a slight downward incline from its rearward region 44 to its forward region 46 and the lip portion 42 curvingly extends upwardly and rearwardly from the forward portion 46.

Of course, as will be understood, the cover member 10 could also be constructed with the leg portion 38 extending generally coplanarly with the cover plate portion 40 to facilitate mounting of the cover member 10 on the roof 18 at its edge 18' beneath the shingles 52 or other roofing material thereon. Additionally, it is contemplated that in some cases it may be desirable or necessary to provide some spacer member between the cover member 10 and the gutter 12 to maintain the desired small spacing between the lip portion 42 of the cover member 10 and the front wall 20 of the gutter 12 which may tend to close under the weight of a high voltage of water runoff from the roof 18.

In operation, water runoff from the roof 18 flows downwardly therealong, over the terminal edge 18' thereof and onto the cover plate portion 40 of the cover member 10. The upwardly and rearwardly-curled nature of the lip portion 42 effectively creates a dam to continued natural flow of the water runoff along the cover plate portion 40 and initially causes a portion of the water runoff to collect within the curled confines of the lip portion 42. As further water runoff from the roof 18 flows downwardly along the cover plate portion 40, the lip portion 42 and the previously collected water runoff held thereby serves to slow such further runoff as the excess runoff flows upwardly and over the lip portion 42 sufficiently to cause water runoff overflowing the lip portion 42 to flow along the curved outward and lower surfaces 42' of the lip portion 42 and ultimately to fall therefrom into the trough 26 of the gutter 12. Leaves, twigs, pine needles and like debris are carried by the water runoff along the roof 18 and the cover plate member 40 but, because of the dam effect created by the lip portion 42, such debris items essentially float through the area of collected water runoff and merely fall by natural gravity vertically downwardly upon passing over the lip portion 42 rather than tending to follow the water along the curved outward surface 42' of the lip portion 42. The corrugations 48 serve to prevent any substantial degree of surface contact by any such debris with the cover plate portion 40 to prevent any tendency of debris to adhere to the cover plate portion 40.

Figure 4:
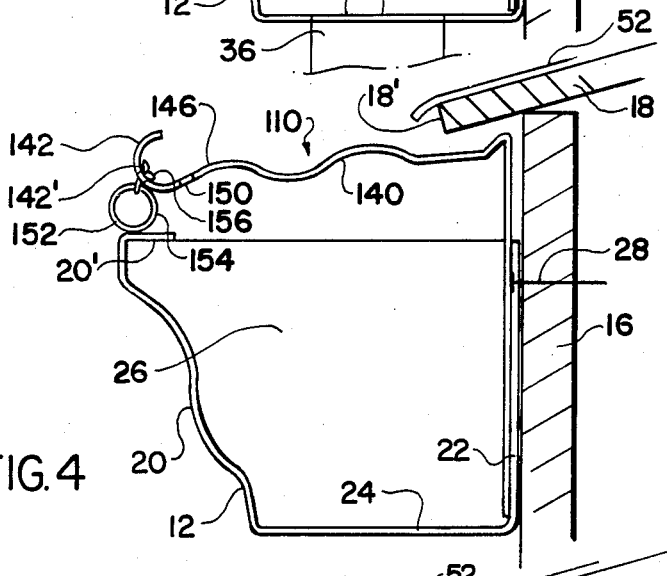
FIG. 4 is a vertical cross-sectional view of the structure of FIG. 3 taken along line 4—4 thereof.
Figure 3:
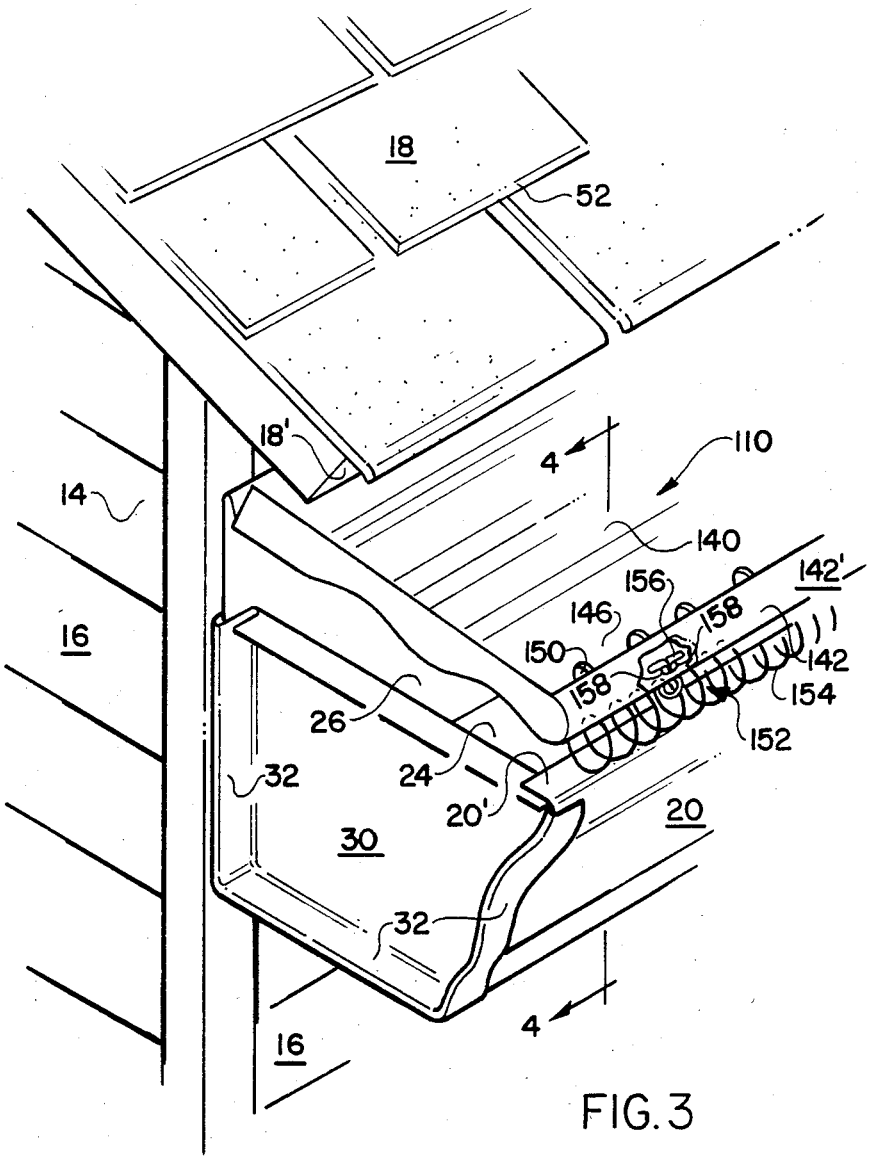
FIG. 3 is a perspective view of a second embodiment of a gutter cover member according to the present invention similarly installed in a conventional gutter system on a building structure.

A second embodiment of cover plate member according to the present invention is illustrated in FIGS. 3 and 4 generally at 110 in combination with a gutter 12 and building structure 14 of identical construction to those of FIGS. 1 and 2 described above. The cover member 110 is of substantially the same construction as the cover member 10 described above, except for the additional provision in the cover member 110 of a plurality of drain openings 150 and a filter member 152. The drain openings 150 are formed through the forward region 146 of the cover plate portion 140 at periodic spacings therealong immediately rearwardly of the lip portion 142. The filter member 152 is a conventional coiled wire spring 154 affixed to the outward surface 142' of the lip portion 142 by spring eyelet clips 156 mounted in openings 158 located at periodic spacings along the lip portion 142. The cover member 110 is assembled with the gutter 12 in the same manner as described above for the cover member 10. In such assembly, the spring 154 of the cover member 110 rests on the flange portion 20' of the front wall 20 of the gutter 12 to extend between the front wall 20 and the lip portion 142 to maintain them in spaced relationship. The cover member 110 also operates in substantially the same manner as the cover member 10, the drain openings 150 however serving to maintain a lower level of collected water runoff behind the lip portion 42 under its damming effect, except under high rates of water runoff, to cause even further slowing of the speed of water overflowing the lip portion 142. For this reason, the cover member 110 is considered to be highly effective for use in gutter embodiments handling large quantities of water runoff from the associated building structure 14. The drain openings 150 are sufficiently small in size and number and will, in any event, often be partially submerged under the water runoff collected behind the lip portion 142 that very little tendency and likelihood exists for such openings 150 to collect debris. The spring 154 poses substantially no restriction to the desired flow along the outward surface 142 of water runoff overflowing the lip portion 142, while providing an extremely effective filter preventing the passage of leaves, twigs and other debris through the flow space between the lip portion 142 and the front wall 20 of the gutter 12.

Figure 6:
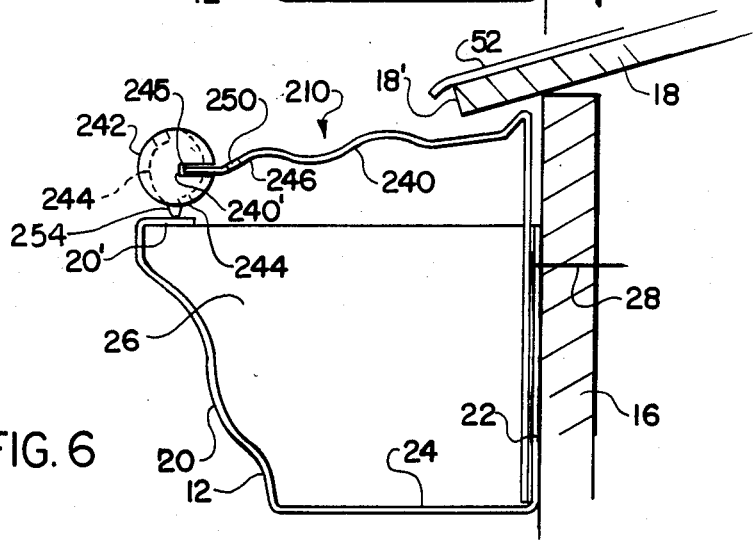
FIG. 6 is a vertical cross-sectional view of the structure of FIG. 5 taken along line 6—6 thereof.
Figure 5:
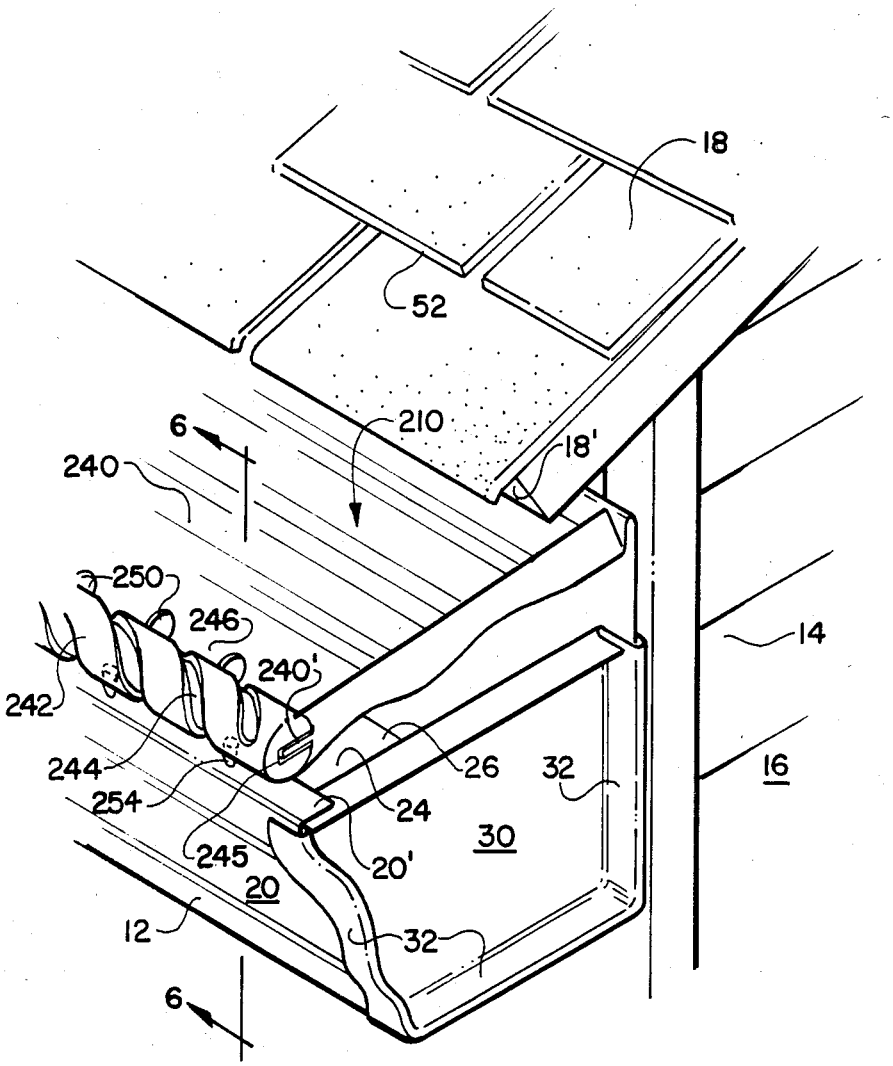
FIG. 5 is a perspective view of a third embodiment of a gutter cover member according to the present invention similarly installed in a conventional gutter system on a building structure.

A third embodiment of cover member according to the present invention is illustrated in FIGS. 5 and 6 generally at 210 as preferably embodied in combination with a conventional gutter 12 and building structure 14 identical to those described above and illustrated in FIGS. 1 and 2. The cover member 210 is substantially identical in construction to the cover member 10 except for the construction and configuration of the lip portion 242. In the cover member 210, the cover plate portion 240 terminates at a substantially outwardly extending edge 240' and the lip portion 242 is formed as an essentially circular enlarged bead fitted on the edge 240' of the cover plate portion 240 by an axially extending slot 245 formed in the bead 242 which receives the edge 240'. The bead 242 has a continuous spiral groove formed circumferentially thereabout along the entire length of the bead 242. The bead 242 also has a plurality of support feet 254 extending radially from the lowermost surface of the bead 242. The cover member 210 is assembled with the gutter 12 in the same manner as described above for the cover member 10, the feet 250 of the bead 242 resting on the flange portion 20' of the front wall 20 of the gutter 12 in the assembly of the cover member 210 with the gutter 12. The cover member 210 operates in essentially the same manner as described above for the cover member 10, with the bead 242 serving to confine and collect a portion of water runoff therebehind, further water runoff flowing through and along the spiral groove 244 about the bead 242 and into the trough 26 of the gutter 12. If water runoff is considerable, the water will also flow over and along the cylindrical periphery of the bead 242 intermediate the spiral groove 244 and therefrom into the trough 26 of the gutter 12. As desired, drain openings 250 may be provided in the forward region 246 of the cover plate portion 240 of the cover member 210 at periodic spacings therealong, as in the cover member 110 of FIGS. 3 and 4, to better enable the cover member 210 to handle larger quantities of water runoff from the roof 18.

As will thus be understood, the cover member of the present invention in each embodiment thereof advantageously provides for reliable flow of water runoff about the lip portion of the cover member into the trough of the associated gutter with little or no water flow escaping over the front wall of the gutter, while at the same time effectively and reliably preventing the passage of any debris such as leaves, twigs, pine needles and the like into the trough of the gutter. This is in substantial contrast to virtually all conventional deflector members and gutter constructions of the type described above, utilizing a downwardly curved arcuate cover portion, wherein the effectiveness of either water collection or debris separation is characteristically sacrificed to optimize the effectiveness of the structure for serving the other purpose. Specifically, with such conventional deflector members and gutter constructions, it typically occurs that a significant amount of water runoff must pass uncollected over the downwardly curved arcuate portion of such structures in order to optimally insure that leaves and other debris do not pass into the gutter or, alternatively, some amount of debris accumulation in the gutter must be tolerated in order to maximize the effectiveness of such structures for water collection. The present invention departs from the teachings of these prior gutter structures by providing an upwardly-extending lip portion to create a dam of water runoff, which unexpectedly enables the achievement of both effective water collection and debris separation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A cover member for a building gutter of the type having spaced upright front and rear walls and a bottom wall extending therebetween forming a collecting trough having an open top and adapted for disposition below a terminal edge of a roof of a building structure with said rear wall most closely adjacent thereto for collecting water runoff from said roof, said cover member comprising a cover plate portion having a rearward region and a forward region, said cover plate portion being adapted for disposition in covering relation over said open top of said gutter with said rearward region extending along said rear wall and beneath said terminal edge of said roof and with said forward region extending along said front wall and outwardly of said terminal edge of said roof, and lip means extending along said forward region and extending upwardly with respect to said forward region, said lip means having a rearwardly facing dam surface to form a dam to water runoff from said roof flowing across said cover plate portion to slow the speed of water runoff from said roof and having a curved forwardly-facing outward surface to cause water runoff flowing over said lip means to flow along said curved outward surface and into said gutter while causing leaves and debris flowing with said water runoff to fall gravitationally over said lip means outwardly of said front wall of said gutter.

2. A cover member for a building gutter according to claim 1 and characterized further in that said lip means comprises an upwardly-curled forward edge portion of said cover member merging integrally and continuously with said forward region of said cover plate portion.

3. A cover member for a building gutter according to claim 2 and characterized further by filter means attached to the underside of said cover member to extend from said cover member to said front wall of said gutter to prevent passage of leaves and debris therebetween while permitting said overflowing water runoff to flow therebetween.

4. A cover member for a building gutter according to claim 3 and characterized further in said filter means comprises a coiled wire spring attached to and extending downwardly from said curved outward surface of said lip means to rest on said front wall of said gutter.

5. A cover member for a building gutter according to claim 1 and characterized further by filter means attached to the underside of said cover member to extend from said cover member to said front wall of said gutter to prevent pasage of leaves and debris therebetwen while permitting said overflowing water runoff to flow therebetween.

6. A cover member for a building gutter according to claim 5 and characterized further in said filter means comprises a coiled wire spring attached to and extending downwardly from said curved outward surface of said lip means to rest on said front wall of said gutter.

7. A cover member for a building gutter according to claim 1 and characterized further in that said lip means comprises a rounded enlarged bead formed at the forward edge of said forward region of said cover plate portion, said bead having groove means formed peripherally therein for directing said overflowing water runoff about said bead and into said gutter.

8. A cover member for a building gutter according to claim 7 and characterized further in that said groove means is spirally formed in said bead.

9. A cover member for a building gutter according to claim 1 and characterized further by a plurality of drain openings formed in said forward region of said cover plate portion at spacings therealong for permitting a portion of said water runoff to flow through said openings into said gutter.

10. A cover member for a building gutter according to claim 1 and characterized further in that said cover member includes a mounting leg extending downwardly from said rearward region of said cover plate portion for disposition within said trough of said gutter in upstanding relation on said bottom wall thereof adjacent said rear wall thereof to support said cover plate portion and said lip means in covering relation over said gutter.

11. A cover member for a building gutter according to claim 1 and characterized further in that said cover plate portion has longitudinal corrugations formed therealong to limit surface contact of debris with said cover plate portion to prevent debris adherence thereto.

12. A cover member for a building gutter according to claim 1 and characterized further in that said cover plate portion is adapted to be oriented at a downward incline from its rearward region to its forward region.

13. In combination with a building structure including a roof having a terminal edge and including further a gutter of the type having spaced upright front and rear walls and a bottom wall extending therebetween forming a collecting trough having an open top, said gutter being mounted to said building structure below said terminal edge of said roof with said rear wall most closely adjacent said building structure for collecting water runoff from said roof, a cover member affixed over said open top of said gutter for directing water runoff to flow thereinto while preventing leaves and debris from entering said gutter, said cover member comprising a cover plate portion being disposed in covering relation over said open top of said gutter with said rearward region extending along said rear wall and beneath said terminal edge of said roof and with said forward region extending along said front wall and outwardly of said terminal edge of said roof, and lip means extending along said forward region and extending upwardly with respect to said forward region, said lip means having a rearwardly facing dam surface to form a dam to water runoff from said roof flowing across said cover plate portion to slow the speed of water runoff from said roof and having a curved forwardly-facing outward surface to cause water runoff flowing over said lip means to flow along said curved outward surface and into said gutter while causing leaves and debris flowing with said water runoff to fall gravitationally over said lip means outwardly of said front wall of said gutter.

14. The combination of claim 13 and characterized further in that said lip means comprises an upwardly-curled forward edge portion of said cover member merging integrally and continuously with said forward region of said cover plate portion.

15. The combination of claim 14 and characterized further by filter means attached to the underside of said cover member to extend from said cover member to said front wall of said gutter to prevent passage of leaves and debris therebetwen while permitting said overflowing water runoff to flow therebetween.

16. The combination of claim 15 and characterized further in said filter means comprises a coiled wire spring attached to and extending downwardly from said curved outward surface of said lip means to rest on said front wall of said gutter.

17. The combination of claim 13 and characterized further by filter means attached to the underside of said cover member to extend from said cover member to said front wall of said gutter to prevent passage of leaves and debris therebetwen while permitting said overflowing water runoff to flow therebetween.

18. The combination of claim 17 and characterized further in said filter means comprises a coiled wire spring attached to and extending downwardly from said curved outward surface of said lip means to rest on said front wall of said gutter.

19. The combination of claim 13 and characterized further in that said lip means comprises a rounded enlarged bead formed at the forward edge of said forward region of said cover plate portion, said bead having groove means formed peripherally therein for directing said overflowing water runoff about said bead and into said gutter.

20. The combination of claim 19 and characterized further in that said groove means is spirally formed in said bead.

21. The combination of claim 13 and characterized further by a plurality of drain openings formed in said forward region of said cover plate portion at spacings therealong for permitting a portion of said water runoff to flow through said openings into said gutter.

22. The combination of claim 13 and characterized further in that said cover member includes a mounting leg extending downwardly from said rearward region of said cover plate portion for disposition within said trough of said gutter in upstanding relation on said bottom wall thereof adjacent said rear wall thereof to support said cover plate portion and said lip means in covering relation over said gutter.

23. The combination of claim 13 and characterized further in that said cover plate portion has longitudinal corrugations formed therealong to limit surface contact of debris with said cover plate portion to prevent debris adherence thereto.

24. The combination of claim 13 and characterized further in that said cover plate portion is oriented at a downward incline from its said rearward region to its said forward region.

* * * * *